US005082227A

United States Patent [19]

Insko

[11] Patent Number: 5,082,227

[45] Date of Patent: Jan. 21, 1992

[54] HANGER AND TOOL FOR SUSPENDED CEILINGS

[75] Inventor: Leo J. Insko, Springfield, Mo.

[73] Assignee: Panel-Lok Hangers, Inc., Springfield, Mo.

[21] Appl. No.: 556,289

[22] Filed: Jul. 23, 1990

[51] Int. Cl.[5] ..... B42F 13/00

[52] U.S. Cl. ..... 248/343; 52/484; 29/243.56; 248/317

[58] Field of Search ..... 248/317, 343, 342, 228, 248/544; 52/484, 732, 144, 145; 81/488; 29/243.56, 278, 243.5; 140/118, 119

[56] References Cited

U.S. PATENT DOCUMENTS

| | | | |
|---|---|---|---|
| 2,894,291 | 7/1959 | Sorenson | 52/484 X |
| 3,525,189 | 8/1970 | Nelsson | 52/732 X |
| 3,780,973 | 12/1973 | Dalton, Jr. | 248/342 |
| 3,964,710 | 6/1976 | Conroy | 248/262 X |
| 4,084,368 | 4/1979 | Stilts | 52/732 X |
| 4,191,352 | 3/1980 | Schuplin | 248/317 |

FOREIGN PATENT DOCUMENTS

| | | | |
|---|---|---|---|
| 2177435 | 1/1987 | United Kingdom | 52/732 |

*Primary Examiner*—Carl D. Friedman
*Assistant Examiner*—Korie H. Chan
*Attorney, Agent, or Firm*—Alan B. Samlan

[57] ABSTRACT

A hanger for use in suspending articles from an overhead suspended ceiling in which the ceiling comprises beams and ceiling panels. The beams may be T-shaped supports or L-brackets. In one embodiment, the hanger has a horizontal portion which is supported by the beam and two vertical projections. One of the vertical projections engages the edge of the ceiling panels and the other receives the object which is to be suspended. An installation tool holds the hanger while lifting the ceiling panels up and away from the beams. After the hanger is placed in position on the beam, the ceiling panel is dropped in place and locks the hanger between the edge of the ceiling panel and the beam. In an alternate embodiment the hanger is provided with clips which engage the T-shaped beam when the hanger is rotated.

14 Claims, 3 Drawing Sheets

Fig. 1
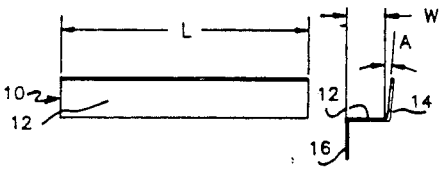
Fig. 3
Fig. 4
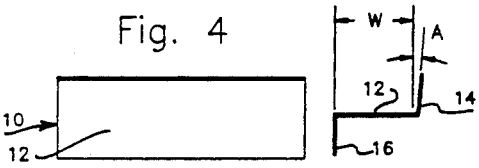
Fig. 6
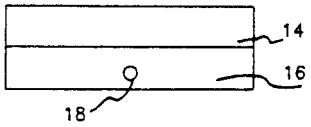
Fig. 2
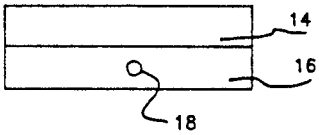
Fig. 5
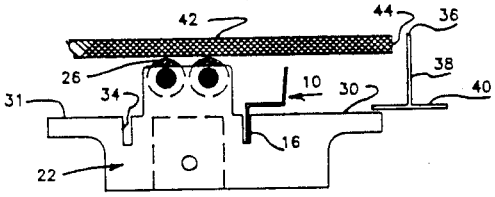
Fig. 11
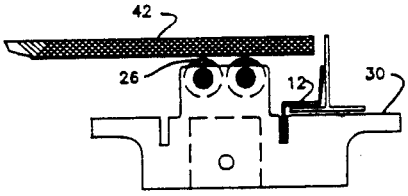
Fig. 12
Fig. 7
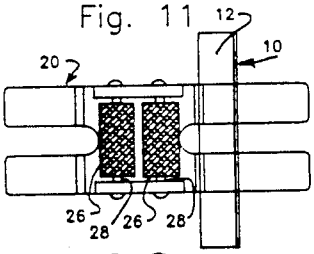
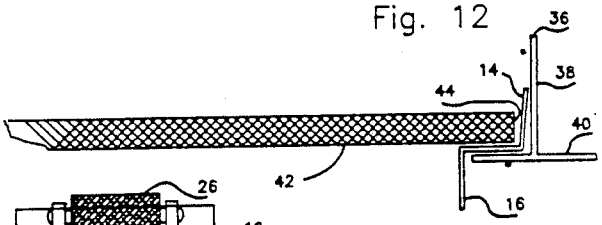
Fig. 13
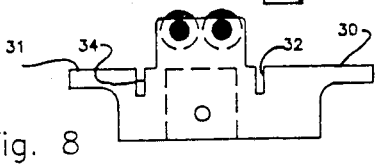
Fig. 8
Fig. 9
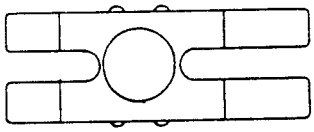
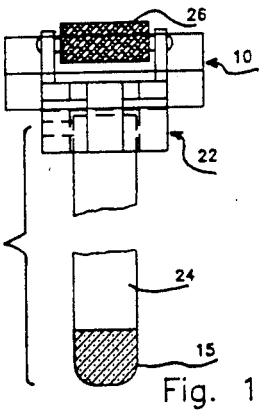
Fig. 10

HANGER AND TOOL FOR SUSPENDED CEILINGS

BACKGROUND OF THE INVENTION

This invention relates to hangers or clips attached to the metal lattice supports of suspended ceilings, such that various signs or objects can be suspended from the hangers.

Metal hangers are generally used for the purpose of hanging signs, advertising material, or other materials from a suspended ceiling. This is usually done by attaching a string or wire to the metal hanger and then tying the sign to the string. Previously this process required that a person who is hanging the sign obtain a ladder sufficiently high so as to allow him to reach the metal strips or supports in the suspended ceiling. Then, while the person is standing on top of the ladder, he has to fasten the metal or plastic hanger to the metal grid work which supports the ceiling tiles. This procedure is precarious and inherently dangerous to the installer.

Placement of the ladder in the aisle to accomplish this task causes interference with customer usage of the aisle. It also presents a risk to customers or employees who may be in the vicinity of the ladder. Such personnel can be hit by falling tools, or implements of the installation or of the sign itself. Furthermore, the installer himself may fall from the ladder which may cause injury to himself and others in the aisle.

This previous installation process required the installer to gather all the tools necessary for the installation, placement of warning signs around the ladder so that customers do not come directly under the ladder, performing the installation task, and then replacing all tools and the ladder. The installation of just one or two hangers required a considerable amount of time and effort in addition to placing the installer and customers at risk of injury.

Several types of hangers or clips have been used in the past. For example, in U.S. Pat. No. 3,612,461 there is illustrated a clip which closely fits about opposite sides of an inverted T-shaped grid member of a suspended ceiling. One end of the clip is supported by a wire connected to the building structure and the other end of the clip is attached to a light fixture or other device to be supported. This clip is not easily installed nor is it retained in place by the ceiling panels such as applicant's device described herein operates.

Other clips or supporting devices are illustrated in U.S. Pat. Nos. 4,318,525; 4,323,215, and 4,075,750. All of these devices have a clip portion or winged member which engages the cross-bar of the inverted T-shaped ceiling support member. In each of these patents, the clip is held in place merely by frictionally engaging the upper and lower faces of this inverted T-shaped member. The ceiling panels do not play any role in locking or retaining the clip.

A light duty clip manufactured of a single length of wire is illustrated in U.S. Pat. No. 3,936,913. A shortcoming of this device is that it is only designed for mounting on an inverted T-bar located away from the corner or walls of a room and is not usable for mounting the clip adjacent to a wall. Furthermore, the design of this clip is such that the upstanding wires engaging the edges of the panel would tend to dig into the panel edges which would permit the clip to rotate. This would further destroy the panel edges which may ultimately result in the failure of the clip.

SUMMARY OF THE INVENTION

In the preferred embodiment, applicant's hanger defines a generally Z-shaped cross sectional configuration. The Z-shaped hanger is designed to be supported by an inverted T-shaped ceiling supporting beam or an L-shaped supporting beam which lies at the intersection between the wall and ceiling. The Z-shaped hanger has a horizontal surface and two substantially vertical projections extending in opposite directions from the sides of the horizontal member. The horizontal member rests on the T-shaped member or L-shaped member which forms the ceiling grid and supports the ceiling panels. The perimeter of the ceiling panel rests on the horizontal surface of the hanger and the edge of the panel rests against one of the vertical projections extending upwardly from the horizontal surface. The hanger is thus securely retained between the ceiling panel and the T-shaped or L-shaped supporting member. The second vertical projection extending in an opposite direction from the first vertical projection is adapted to receive the device which is to be hung or, alternatively, can receive a hanging member attached to a sign or other such display device.

The Z-shaped clip has two configurations, both being substantially identical with the exception of the width of the horizontal member. A wider horizontal member is utilized when the hanger is to be placed on an L-shaped member adjacent to a corner of the room and a narrower horizontal member is used when the hanger is adapted to be hung from the inverted T-shaped supporting member.

In combination with the hanger, applicant has designed an installation tool. The tool holds the hanger during installation and also raises up the ceiling panel to provide access to the supporting beams. When the hanger is placed in position against the supporting member, the tool is then removed and the ceiling panel permitted to drop in place thereby securely retaining the hanger in its proper position.

In an alternative embodiment, the hanger is designed with two U-shaped clips located at opposite ends of the hanger. The clips are both open at the end facing the center of the clip. The clip is positioned across the inverted T-shaped member and rotated 90 degrees. The clips are thus spread apart and each envelopes the T-shaped support. The installation tool is removed and the clip is retained on the T-shaped member. Additionally, each clip has an upstanding vertical projection which is retained between the vertical portion of the T-shaped member and the edge of the ceiling panel. Thus, the clip hanger is retained not only by the clips wrapping around the inverted portion of the T, but further secured in place by the ceiling panels securing the vertical projection and engaging it between the edge of the ceiling panel and the vertical portion of the inverted T-shaped support.

OBJECTS AND ADVANTAGES

An object of the hanger system is to provide an improved hanger and a unique installation tool which works in conjunction with the hanger to hang signs from suspended ceilings.

Another object is to provide a hanger and tool combination which will save time and increase safety when hanging signs and other such devices from suspended ceilings. Related to this object is the object of providing a hanger and tool which eliminates the need to use a ladder when hanging signs from a suspended ceiling.

Another object is to provide a hanger system that is easily installed by employees with a minimum amount of training or skill. Related to this object is the object of providing a hanger and installation tool which can be used by employees who may have physical disabilities prohibiting them from climbing a ladder.

Another object is the object of providing a hanger system that securely mounts the hanger to the gridwork of the suspended ceiling in a secure, safe manner, which will not be easily dislodged or moved.

Still yet another object is the object of providing a hanger which is locked into place by the ceiling panels interfacing with the hanger and ceiling grid system.

Still another object is the object of providing a hanger which is simple in design, economical to manufacture, and yet strong and simple in installation. Related to this object is the object of providing an installation tool which interfaces with the hanger and is easy to use such that the hangers can be easily and quickly installed and removed.

These and other objects and advantages of the present invention will become apparent to those skilled in the art when the following brief description of the drawings and detailed description of the preferred embodiment are studied.

BRIEF DESCRIPTION OF THE DRAWINGS

FIG. 1 is a top view of one embodiment of the hanger.

FIG. 2 is a front view of the hanger shown in FIG. 1.

FIG. 3 is an end view of the hanger.

FIG. 4 is a top view of another embodiment of the hanger shown in FIG. 1.

FIG. 5 is a front view of the hanger shown in FIG. 4.

FIG. 6 is an end view of the hanger shown in FIG. 4.

FIG. 7 is a top view of the installation tool holding the hanger in place prior to installation.

FIG. 8 is a side view with portions removed of the installation tool.

FIG. 9 is a bottom view of the installation tool shown on FIG. 7.

FIG. 10 is an end view with portions removed of the installation tool as shown in FIG. 7.

FIG. 11 is a side view partially in cross-section showing the hanger raising the ceiling panel just prior to installation of the hanger.

FIG. 12 is a side view partially in cross-section showing the hanger being installed, FIG. 13 is a cross-sectional view of the hanger after installation and held in place by the T-shaped member and ceiling panel.

DETAILED DESCRIPTION OF THE PREFERRED EMBODIMENT

Figure 14:
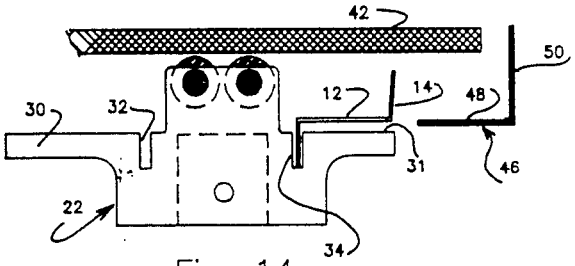
FIG. 14 is a side view partially in cross-section with portions removed showing the installation tool raising the ceiling panel prior to installation of the hanger on an L-bracket.
Figure 16:
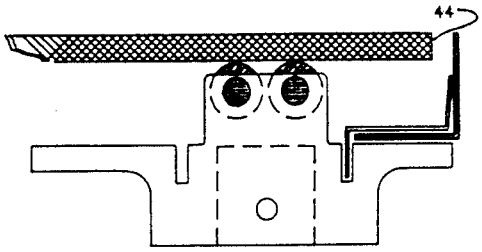
FIG. 16 is a side view partially in cross-section with portions removed showing the ceiling panel being raised and the clip shown in FIG. 14 being positioned onto the L-bracket.
Figure 15:
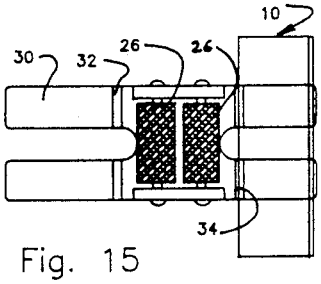
FIG. 15 is a top view of the installation tool with the alternate ceiling clip being held in place.

Turning first to FIGS. 1 through 3 there is shown a hanger 10 of the present invention. The hanger 10 has a horizontal portion 12, first vertical projection 14 and second vertical projection 16. The first vertical projection 14 projects upwardly from the horizontal portion 12 and the second vertical projection 16 projects downwardly from the horizontal portion 12. The horizontal portion 12 and first and second vertical projections 14 and 16 are generally rectangular in configuration. The first vertical projection 14 is connected to the horizontal portion 12 along a common edge and the second vertical projection 16 is connected to the horizontal portion 12 along a second common edge. As seen in FIG. 3, the first vertical projection 14 forms a positive angle A with respect to a vertical line. Also as seen in FIG. 3, the horizontal portion 12 has a width W of approximately ½ inch.

A similar hanger 10' is illustrated in FIGS. 4 through 6. The hanger 10' has a horizontal portion 12' which is approximately 1.0 inch as shown by W'. All of the other elements of the hanger 10' are identical to the hanger 10 illustrated in FIGS. 1 through 3. The hanger itself is constructed of metal or plastic and has a hole 18 in the second vertical projection 16. The purpose of the hole 18 is to allow the user to tie a string, cord, or wire through the hole to enable the user to hang a sign or other article to be suspended from the hanger 10.

FIGS. 7 through 9 illustrate an installation tool 20 used to install the hanger 10 on a suspended ceiling. The installation tool 20 has a head 22 at one end of a telescopic rod 24. At the other end of the rod 24 is a rubber tipped bottom 25 which keeps the rod from slipping along the floor when it is placed upright and not in use. There are a pair of rollers 26 mounted on shafts 28. There is a flat shelf 30 on one side of the pair of rollers 26 and a second shelf 31 of lesser width on the opposite side of the rollers. A groove 32 is cut into the shelf 30 and a similar groove 34 is cut into the shelf 31. As previously stated, the shelf 30 extends further from the rollers than the shelf 31 the reason for which will be described later.

The suspended ceiling has a metal gridwork of inverted T-shaped support beams 36. The T-shaped beam has a vertical portion 38 and a horizontal portion 40 more clearly shown in FIG. 11. There is a plurality of ceiling panels 42 which are supported by the T-shaped beam 36. The ceiling panels 42 have a perimeter portion which rests upon the horizontal portion 40 of the support beam 36. There is an edge 44 around the perimeter of the panel 42. Generally the T-shaped support beams 36 are placed throughout the central area of the ceiling, but cannot be utilized where the ceiling intersects with a vertical wall. At such an intersection an L-bracket supporting beam 46 is used (FIG. 14). As seen in FIG. 11 when the hanger 10 is to be installed, it has its second vertical projection, 16 inserted into the groove 32. The horizontal portion 12 generally rests on the shelf 30. The first vertical projection 14 projects upward from the shelf 30. The tool 20 is raised until the rollers 26 engage the underside of the ceiling panel 42. Continued upward movement causes the panel 42 to be raised up from the horizontal portion 40 of the T-shaped support beam 36. Once the panel 42 is raised, the installation tool 20 is moved horizontally toward the T-shaped support beam 36. The rollers 26 will roll along the underside of the ceiling panel 42 and thus not damage the surface of the panel 42. The shelf 30 will slide under the bottom of the horizontal portion 40 of the T-shaped support beam 36 as illustrated in FIG. 12. Horizontal movement of the installation tool 20 continues until the first vertical projection 14 engages the vertical portion 38 of the T-shaped support beam 36. At this point horizontal movement of the installation tool is stopped and the tool is lowered. The ceiling panel 42 will drop due to gravity onto the horizontal portion 12 of the hanger 10. The hanger 10 is thus locked in place between the ceiling panel 42 and its edge 44 and the inverted T-shaped support beam 36 as illustrated in FIG. 13. The angle which the first vertical projection 14 makes with a vertical line, or with the edge 44 of the panel 42, aids in permitting the panel 42 to drop into position without catching on the uppermost edge of the first vertical projection 14. In this manner, the edge 44 of the panel 42 is guided along the surface of the first vertical projection 14 until it seats on the horizontal portion 12.

At times it is desirable to install the hanger at the intersection between the ceiling and a wall. Generally, at this intersection, a T-shaped support beam is not used, but rather an L-shaped bracket or supporting beam 46 is used. The L-bracket 46 has a horizontal portion 48 and a vertical portion 50 as seen in FIG. 14. FIGS. 14 through 17 illustrate the method and installation tool utilized in installing the hanger 10' onto the L-bracket 46.

Figure 17:
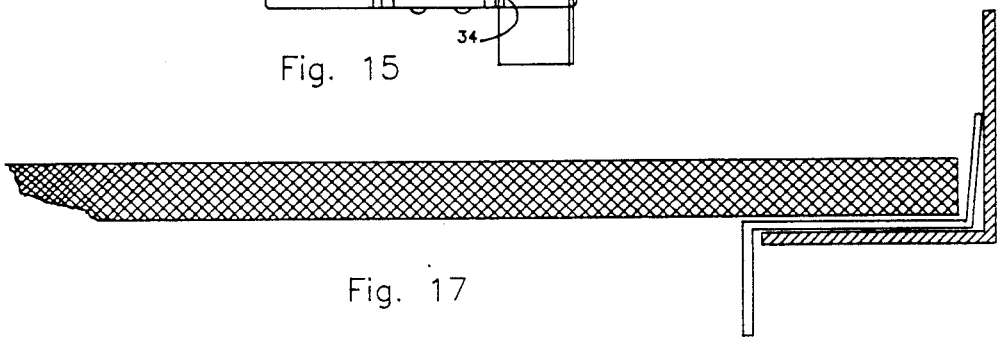
FIG. 17 is a cross-sectional view showing the ceiling panel and L-bracket holding the hanger in place.

First, the hanger 10' has its second vertical projection 16 placed into the groove 34 on the shorter dimensioned shelf 31. The installation tool 20 is again raised just as when the installation is done on the T-shaped support beam. The rollers 26 will engage the underside of the ceiling panel 42 and raise it as shown in FIG. 14. The tool is then moved horizontally such that the hanger 10' assumes the position illustrated in FIG. 16. The shelf 31 will slide underneath the horizontal portion 48 of the L-bracket 46. As the shelf 31 is smaller than the shelf 30, the head 22 is allowed to come into much closer proximity to the wall then if the shelf 30 were used to hold the hanger 10'. The width of the horizontal portion 48 is approximately 1 inch which is the same width as the horizontal portion 12' of the hanger 10'. With the hanger 10' in the position shown in FIG. 16 the tool 20 is lowered and the edge 44 of the ceiling panel 42 will be guided along the inside surface of the first vertical projection 14 such that the panel 42 will drop in place on top of the horizontal portion 12' of the hangar 10'. As seen in FIG. 17, the hanger 10' will be retained between the ceiling panel 42 and the L-bracket 46.

The hanger 10 and 10' along with the installation tool 20 is the preferred form of the invention. It provides a hanger which is simple to manufacture and, although inexpensive in design is extremely easy to install and provides a hanger which is capable of supporting loads to the extent that the support beams can support the same load. It resists rotation in both the horizontal and vertical planes because of its locking engagement with the edge 44 of the panel 42 retaining the hanger against the support beam.

Figure 18:
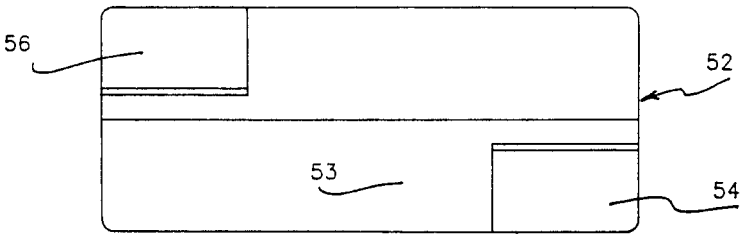
FIG. 18 is a top view of an alternate clip hanger.
Figure 19:
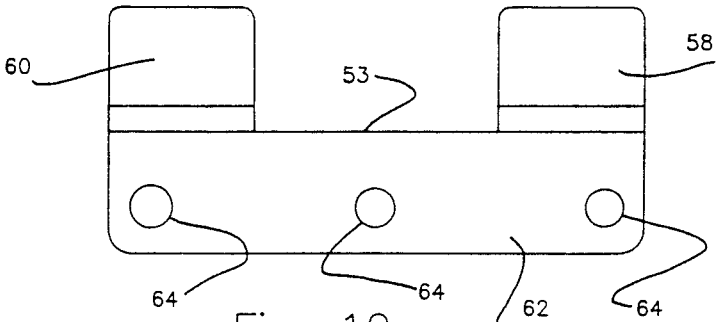
FIG. 19 is a front view of the alternate clip hanger of FIG. 18.
Figure 20:
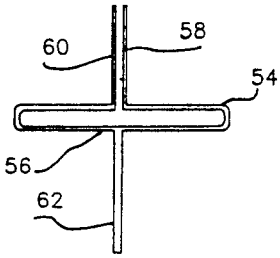
FIG. 20 is an end view of the alternate clip hanger shown in FIG. 18.
Figure 21:
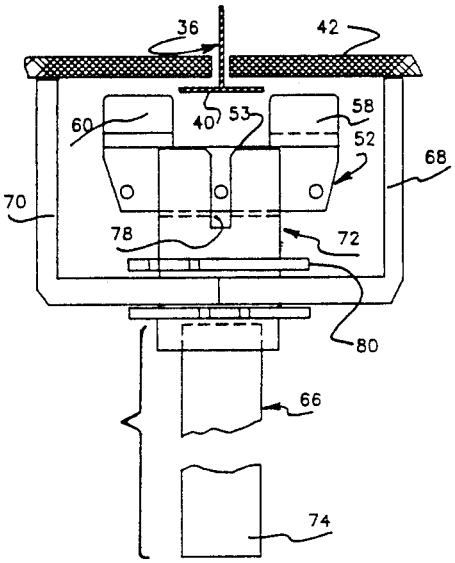
FIG. 21 is a side view partially in cross-section with portions removed of an installation tool holding the alternate clip and partially raising the ceiling panels prior to installation of the clip on a T-shaped support.

An alternative embodiment is illustrated as the clip hanger 52 in FIGS. 18 through 20. The clip hanger 52 is adapted for installation on the inverted T-shaped support beam 36 but not on the L-bracket 46. The clip hanger 52 has a horizontal surface 53 which, during installation, engages the underside of the horizontal portion 40 of the inverted T-shaped support beam 36. There is a U-shaped clip 54 and 56 located at opposite ends of the clip hanger 52. The U-shaped clip 54 has a first vertical projection 58 and the U-shaped clip 56 has a second vertical projection 60, as illustrated in FIG. 19. There is a third downwardly extending vertical projection 62 which has a series of holes 64 therein to receive the string, cord, or wire of the device or sign to be hung.

An installation tool 66 is used to install the clip hanger 52. The installation tool 66 has a pair of upstanding arms 68 and 70 extending outward and upward from the tool 66. There is a head 72 at one end of a telescopic rod 74. The head 72 has a groove 76 cut therein. There is, in addition, a cross groove 78 at right angles to the groove 76. The third vertical projection of the clip hanger 52 is received within groove 76 with the clip 52 which is supported within the head 72. The installation tool 66 is then raised up towards the ceiling panels 42. The first and second vertical projections, 58 and 60, ar positioned on either side of the horizontal portion 40 of the T-shaped support beam 36. The installation tool 66 is raised further until the upstanding arms 68 and 70 raise the ceiling panels 42 up off the horizontal portion 40.

Figure 22:
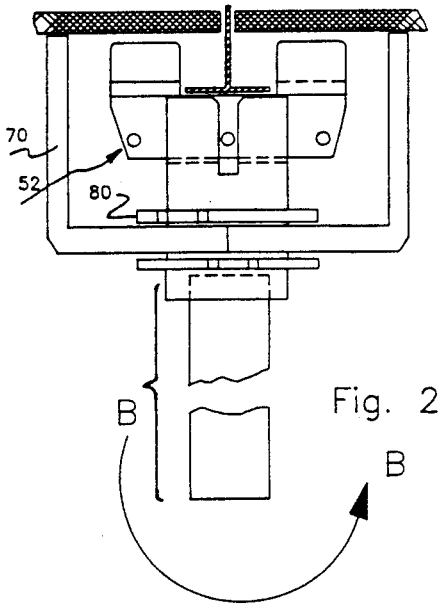
FIG. 22 is a side view partially in cross-section with portions removed showing the clip in position just prior to it being rotated and installed onto the T-shaped support member.
Figure 23:
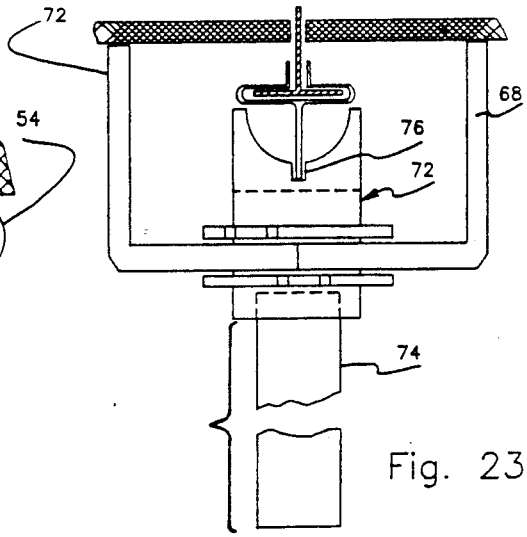
FIG. 23 is a side view partially in cross-section showing the installation tool rotated 90 degrees and the clip installed onto the T-shaped ceiling member.

Further movement in the vertical direction of the installation tool results in the ceiling panels being completely raised off of the horizontal portion and the first and second vertical projections, 58 and 60, surrounding the horizontal portion 40 of the T-shaped support beam 36. As seen in FIG. 22 the horizontal portion 40 will engage the horizontal surface 53 of the clip hanger 52. The design of the tool 66 is such that the telescopic rod 74 passes through an opening (not illustrated) in the bottom of the upstanding arms 68 and 70. A locking ring 80 supports the head 72 within the upstanding arms 68 and 70, yet allows the telescopic rod 74 to rotate freely therein. Accordingly, once the tool has raised the panels 42 to the position shown in FIG. 22, the rod 74 is rotated 90 degrees in the direction of the arrow indicated as B—B. This causes the clips 54 and 56 to slide onto and engage the metal T-shaped support beam 36. Continuing the application of the force until a resistance is met will align the clip hanger 52 so that it is parallel with the long axis of the T-shaped support beam 36. As illustrated in FIG. 23, the U-shaped clips 54 and 56 have surrounded the T-shaped support beam 36. In this position the panels 42 are still elevated above the clip hanger 52.

Figure 24:
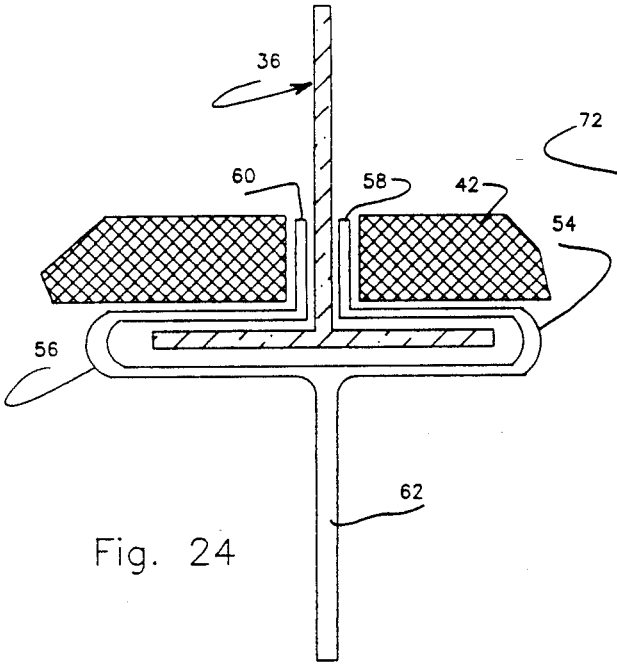
FIG. 24 is an enlarged view showing the alternate clip installed on the T-shaped support with the ceiling panels firmly retaining the clip in position.

The installation tool 66 is lowered and the ceiling panels 42 will drop down upon the U-shaped clips 54 and 56. The vertical projections 58 and 60 will engage the edges of the ceiling panel 54. The ceiling panels thus lock the hanger clip into position by contacting these vertical projections in such a way that the hanger clip is constrained from any movement and will remain so until the ceiling panels are raised above the first and second vertical projections 58 and 60 (as illustrated in FIG. 24).

Thus, it is apparent that there has been provided, in accordance with the invention, a hanger and tool for suspended ceilings that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A hanger and overhead suspended ceiling comprising in combination: a ceiling having beams and ceiling panels,, the beams having at least one horizontal supporting surface and an upstanding vertical surface, the ceiling panels having perimeter portions adapted to rest upon the horizontal supporting surface, the ceiling panels further having an edge around their perimeters, the hanger comprising:

a horizontal member supported by the horizontal supporting surface of the beam, first and second substantially vertical projections connected to the horizontal member and extending therefrom in opposite directions, the first vertical projection being an upstanding rectangular plate, the horizontal member and rectangular plate connected along a common edge and defining a corner which receives the edge of the ceiling panel, the first vertical projection further having two sides, one side adapted to engage the edge of the ceiling panel and the other side engaging the upstanding vertical surface of the beam, the second vertical projection being a downturned second rectangular plate with a receiving hole therein, the horizontal member and second rectangular plate connected along a common edge, the horizontal member and two vertical projections defining a Z-shaped cross-sectional configuration, whereby angular and rotational movement of the hanger is restricted by the hanger being retained between the edge and perimeter portions of the ceiling panel and the upstanding vertical and horizontal supporting surfaces of the beam.

2. The hanger of claim 1 wherein the first vertical projection defines a positive angle with respect to the edge of the panel whereby permitting the panel to having clearance with respect to the first vertical projection when the panel is dropped into engagement with the hanger.

3. The hanger of claim 1 in combination with a tool for manipulating the hanger into and out of its retained position with respect to the beam and ceiling panels, the tool comprising a pole having a head at one end, the head having a raised top which is adapted to engage the ceiling panels means in the head for receiving the second rectangular plate, means on the head for supporting the hanger, whereby vertical movement of the raised top lifts the ceiling panel and horizontal movement of the tool causes the horizontal member of the hanger to slide over the horizontal supporting surface of the beam until the hanger is positioned with its first vertical projection engaging the upstanding vertical surface of the beam at which time the tool is lowered causing the ceiling panel to be lowered into its retaining position engaging the hanger between the ceiling and the beam.

4. The hanger and tool of claim 3 and further comprising a roller on the head which engages and rolls across the ceiling panels.

5. A ceiling hanger system comprising in combination:

an overhead suspended ceiling having ceiling beams and ceiling panels, the ceiling beams having at least one horizontal supporting surface and an upstanding vertical surface, the ceiling panels having perimeter portions adapted to rest upon the horizontal supporting surface, the ceiling panels further having an edge around their perimeters, a hanger comprising:

a horizontal member supported by the horizontal supporting surface of the beam, first and second substantially vertical projections connected to the horizontal member nd extending therefrom in opposite directions, the first vertical projection being an upstanding rectangular plate, the horizontal member and rectangular plate connected along a common edge and defining a corner which receives the edge of the ceiling panel, the first vertical projection further having two sides, one side adapted to engage the edge of the ceiling panel and the other side engaging the upstanding vertical surface of the beam, the second vertical projection being a downturned second rectangular plate, and a tool for manipulating the hanger into and out oft the retained position with respect to the beam and ceiling panels, the tool comprising a pole having a head at one end, the head having raised top which is adapted to engage the ceiling panels, means in the head for receiving the second rectangular plate, and means on the head for supporting the hanger, whereby vertical movement of the raised top lifts the ceiling panel and horizontal movement of the tool causes the horizontal member of the hanger to slide over the horizontal supporting surface of the beam until the hanger is positioned with its first vertical projection engaging the upstanding vertical surface of the beam at which time the tool is lower causing the ceiling panel to be lowered into its retaining position engaging the hanger between the ceiling panel and the beam.

6. The system of claim 5 and further comprising means on the second vertical projection for connecting an article to be suspended.

7. The system of claim 6 wherein the means for connecting comprises a receiving hold in the second vertical projection.

8. The system of claim 5 wherein the second downturned rectangular plate and the horizontal member are connected along a common edge, the horizontal member and two vertical projections defining a Z-shaped cross sectional configuration.

9. The system of claim 5 wherein the first vertical projection defines a positive angle with respect to the edge of the panel thereby permitting the panel to have clearance with respect to the first vertical projection when the panel is dropped into engagement with the hanger.

10. A hanger and tool for use in manipulating the hanger into and out of a retained position with respect to an overhead suspended ceiling comprising in combination:

a ceiling having beams and ceiling panels, the beams having at lest one horizontal supporting surface and an upstanding vertical surface, the ceiling panels have perimeter portions adapted to rest upon the horizontal supporting surface, the ceiling panels further having an edge around their perimeters, the hanger comprising:

a horizontal member supported by the horizontal supporting surface of the beam, first and second substantially vertical projections connected to the horizontal member and extending therefrom in opposite directions, the first vertical projection being an upstanding rectangular plate, the horizontal member and rectangular plate connected along a common edge and defining a corner which receives the edge of the ceiling panel, the first vertical projection further having two sides, one side adapted to engage the edge of the ceiling panel and the other side engaging the upstanding vertical surface of the beam, the second vertical projection being downturned second rectangular plate, and a tool for manipulating the hanger into and out of the retained position with respect to the beam and ceiling panels, the tool comprising a pole having a head at one end, the head having raised top which is adapted to engage the ceiling panels, means in the head for receiving the second rectangular plate, and means on the head for supporting the hanger.

11. The hanger of claim 10 and further comprising connecting means on the second vertical projection for connecting an article, there are two.

12. The hanger of claim 11 wherein the means for connecting comprises a receiving whole.

13. The hanger of claim 10 wherein the horizontal member and second rectangular plate are connected along a common edge, the horizontal member and two vertical projections defining Z-shaped cross-sectional configuration.

14. The hanger of claim 10 wherein the first vertical projection defines a positive angle with respect to the edge of the panel thereby permitting the panel to have clearance with the respect to the first vertical projection is dropped into engagement with the hanger.

* * * * *